US005860565A

United States Patent [19]

Winston et al.

[11] Patent Number: 5,860,565

[45] Date of Patent: Jan. 19, 1999

[54] PLURAL CHAMBERED SQUEEZABLE DISPENSING TUBE

[75] Inventors: Anthony E. Winston, East Brunswick; Norman Usen, Marlboro; Linda J. Lancaster, Old Bridge, all of N.J.

[73] Assignee: Enamelon, Inc., Cranbury, N.J.

[21] Appl. No.: 855,524

[22] Filed: May 13, 1997

[51] Int. Cl.[6] ..... B65D 35/32

[52] U.S. Cl. ..... 222/1; 222/94

[58] Field of Search ..... 222/1, 94, 129

[56] References Cited

U.S. PATENT DOCUMENTS

| | | | |
|---|---|---|---|
| 3,290,422 | 12/1966 | Michel . | |
| 3,307,738 | 3/1967 | Scheindel . | |
| 3,506,157 | 4/1970 | Dukess . | |
| 3,980,222 | 9/1976 | Hood | 222/94 |
| 4,080,440 | 3/1978 | DiGiulio et al. . | |
| 4,397,837 | 8/1983 | Raaf et al. . | |
| 5,076,464 | 12/1991 | Simon . | |
| 5,244,120 | 9/1993 | O'Meara . | |
| 5,269,441 | 12/1993 | O'Meara . | |
| 5,318,203 | 6/1994 | Iaia et al. . | |
| 5,628,429 | 5/1997 | Usen et al. | 222/1 |

FOREIGN PATENT DOCUMENTS

| | | | |
|---|---|---|---|
| 961154 | 5/1950 | France | 222/94 |

*Primary Examiner*—Philippe Derakshani
*Attorney, Agent, or Firm*—Depaoli & Frenkel, P.C.

[57] ABSTRACT

A planar, partition-forming insert member, when disposed in a tube, e.g., a toothpaste tube, divides the tube into two compartments for storage of two components which are to be prevented from reacting until the product is ready for use. A dual-compartment assembly contains the two separate compartments in which the two components are stored until the compartments are opened for use. The assembly contains a dispensing tube and the planar partition-forming insert member disposed in the tube, the insert member causing the tube to be divided into the two compartments. The assembly is capable of separately storing the components in the two compartments and simultaneously dispensing the components from the two compartments.

50 Claims, 4 Drawing Sheets

PLURAL CHAMBERED SQUEEZABLE DISPENSING TUBE

BACKGROUND OF THE INVENTION

The present invention relates to plural compartment assemblies in which materials are stored in at least two separate compartments until the compartments are opened for use. More particularly, the invention relates to dispensing means whereby the use of a novel insert allows a conventional dispensing tube to be divided into separate and discrete compartments at a low cost. The resulting dispensing assembly provides for the dispensing of more than one material from the same tube and even more particularly the co-dispensing of predetermined proportions of incompatible materials simultaneously and effectively.

There are many products on the market today and many more waiting to be marketed wherein the components of the products must be kept separate from each other because of their instability or the release of actives therefrom but also must or desirably be dispensed simultaneously from the products.

Some of the dual-dispensed products on the market today are peroxide toothpastes, hair coloring, epoxy adhesives, and the like. Many of these products require costly dispensers and fabricating and packaging equipment to produce dispensing means which deliver the separate components simultaneously. Besides the high cost, most of the dual-dispensers available today are not reliable and require a change in the target consumers' normal use habits with the product. These restrictions also keep out of the market many products which can bring major benefits to consumers but which require dual-dispensing.

Products consisting of two flowable components such as pastes, gels, or liquids which must be stored separately are desirably packaged in containers having two compartments. Tubular bodies having chordal partitions are useful in providing two-compartment containers for two-component products which must have predetermined proportions of their components mixed at the time or point of use.

A number of longitudinally partitioned tubular bodies and dispensing containers having chordal partitions have been disclosed in the art. For instance, U.S. Pat. No. 3,290,422, issued Dec. 6, 1966 to Michel, discloses a method of producing a dispensing container by injection molding a head fitment and a longitudinally extending partition onto and inside of, respectively, a tubular body. Tubular containers having asymmetrically disposed chordal partitions are disclosed in U.S. Pat. No. 3,506,157, issued Apr. 14, 1970 to Dukess. Tubular bodies formed from sheet material are also disclosed in the prior art in, for example, U.S. Pat. No. 3,307,738, issued Mar. 7, 1967 to Scheindel.

U.S. Pat. No. 5,076,464, issued Dec. 31, 1991 to Simon discloses a deformable tubular container which includes at least one longitudinal corrugated partition-forming wall which defines distinct compartments and which lends itself to a flattened seal at the end of the tube body. Here too, however, the body and wall are produced by injection molding in a mold and the wall is permanently molded to the body. U.S. Pat. Nos. 5,244,120 and 5,269,411, issued to O'Meara on Sep. 14, 1993 and Dec. 31, 1993, respectively, are similar in the scope of disclosure to the above-mentioned earlier patent.

None of the above-referenced prior art has, however, solved all the problems associated with providing longitudinally partitioned tubular bodies such as, for example, simplicity of manufacture, at a low cost and without changing consumers' habits in the manner of, nor to the degree of, the present invention.

There are many cleaning, drug and personal products which are marketed today in single dispensing packages which could be dramatically improved if an inexpensive dual-dispensing device were available. For example, products containing oxidizing agents, reducing agents, solvents, or materials with high or low pH's can be improved aesthetically by separating the flavor, fragrance or other components that normally would not withstand shelf life.

Many of the dually-dispensed products which are currently on the market and those which are not yet on the market can be dispensed from a tube rather than from more costly dispensing means. A tube is a dispensing device that is readily available, familiar to most consumers, is comparatively less expensive and does not require elaborate filling equipment. If commercially available tubes can be easily and cheaply converted into dual-dispensing devices, it would be a great advantage to those either currently marketing or planning to market dually-dispensed products.

SUMMARY OF THE INVENTION

This invention relates to an inexpensive insert member that is die cut and inserted into a commercially available tube on the product filling line, thereby dividing the tube volume into two distinct chambers before filling by the addition of each of two materials. By the addition of the novel insert member, a conventional dispensing tube can be divided into separate and distinct compartments for dispensing more than one material from the same tube and, advantageously, for co-dispensing incompatible materials simultaneously and at a low cost.

By using commercially available tubes, there is no need to interfere with the tube manufacturing process, speed of production or cost. Advantageously, the later addition of the insert member (possibly during the product filling operation) to form the co-dispensing unit, will cost far less, be more readily available in the size and form needed than existing molded codispensing units, and will not require a change in the consumers' use habits. To the consumer, the dual-chambered tube looks and operates the same as a tube with a single compartment.

There are three major types of tubes commercially available which are suitable for dispensing products for consumer and professional use. The insert member used in the present invention will work in all three tube types, i.e., laminated, plastic or aluminum, converting each into a dual-dispensing tube. The insert member used for each different tube type is inexpensive to produce and can be of a different base material or coating according to the tube into which it will be inserted. Allowance must be made, however, for proper sealing of the insert member inside the tube so as to not interfere with the normal sealing or crimping of the tube after product addition. Thus, the insert member can be made from polycoated board, polyethylene sheet, laminated board or any other inexpensive material that can be formed, preferably by die cut, and is able to heat seal or mechanically crimp to commercially available tubes.

The insert member of the present invention, once installed into the tube, seals against the walls of the tube by folded flaps formed by scoring the insert material. The insert member force-fits against the inside collar of the tube and the center or spine of the insert member extends up through the tube neck and, if desired, out the top orifice. In this way, the insert member divides the internal volume of the tube in half so that each half can be filled with separate materials.

After the two compartments are filled and the bottom of the tube is sealed, the components of the product can be dispensed simultaneously but without contact until the components leave the tube.

The insert member can also be coated with materials that either chemically or physically seal the two compartments from cross contamination depending on the products to be separated and the degree of separation required.

One embodiment of the present invention relates to a substantially planar partition-forming insert member suitable for insertion into a squeezable cylindrical tube so as to form a partition and two separate and discrete compartments within the tube. Such tube has a dispensing end to which are affixed a shoulder and a neck terminating as a dispensing orifice and adapted to receive a closing cap and an open filling end into which the partition-forming insert member is inserted prior to filling.

The insert member of this invention is composed of:

(A) a first end corresponding to the dispensing end of the tube;

(B) a first portion adjacent to the first end;

(C) a mid-portion adjacent to the first portion;

(D) a terminal end corresponding to the filling end of the tube; and (E) first and second longitudinal sides;

wherein the insert member has a configuration such that when the insert member is inserted into the tube:

(i) the first end of the insert member corresponding to the dispensing end of the tube is substantially equal to the inner diameter of the neck and extends into the neck, (ii) the first portion of the insert member conforms to the shape of the tube shoulder, (iii) the mid-portion of the insert member extends within the tube and has a width corresponding to at least one-half the inner circumference of the tube, and (iv) the terminal end of the insert member corresponding to the filling end of the tube has a width substantially equal to one-half the inner circumference of the tube;

The insert member of this invention is scored along the first and second longitudinal sides at a distance from respective first and second longitudinal edges of the insert member such that when fully inserted into the tube the insert member folds along the scoring to form a spine between the scoring and first and second flaps adjacent to the scoring. The first flap is disposed in the first longitudinal side and the second flap is disposed in the second longitudinal side. At least one of the first and second flaps having a width sufficient to allow the flap to wrap around an inner surface of the tube and extend behind the other flap.

The partition-forming insert member is composed of a material sufficiently resilient such that the insert member tends to revert to its original planar configuration, thereby causing pressure of the flaps against the inner surface of the tube and providing a seal along a longitudinal edge of the insert member with the inner surface of the tube.

The configuration into which the insert member folds advantageously provides that when the tube is filled with product(s), such product(s) exerts pressure against the surfaces of the flaps so as to force the flaps against the inner surface of the tube and improve the seal of the flaps against such tube's inner surface wall.

Another embodiment of the present invention is directed to a squeezable dual compartment dispensing tube assembly, containing:

(a) a tube having two adjacent compartments, a dispensing end and a filling end, the dispensing end having affixed thereto a shoulder and a neck terminating as a dispensing orifice and adapted to receive a closing cap, the filling end being sealed after contents are placed in the compartments; and (b) a substantially planar partition-forming insert member positioned in the tube, the insert member providing the two adjacent compartments defined by a common wall segment and a pair of outer arcuate walls, the insert member containing:

(A) a first end corresponding to the dispensing end of the tube;

(B) a first portion adjacent to the first end;

(C) a mid-portion adjacent to the first portion;

(D) a terminal end corresponding to the filling end of the tube; and (E) first and second longitudinal sides;

wherein in flattened form the insert member has a configuration generally conforming to that of the tube, further wherein the insert member has a configuration such that when the insert member is inserted into the tube:

(i) the first end of the insert member corresponding to the dispensing end of the tube is substantially equal to the inner diameter of the neck and extends into the neck, (ii) the first portion of the insert member conforms to the shape of the tube shoulder, (iii) the mid-portion of the insert member extends within the tube and has a width corresponding to at least one-half the inner circumference of the tube, and (iv) the terminal end of the insert member corresponding to the filling end of the tube has a width substantially equal to one-half the inner circumference of the tube;

further wherein the insert member is scored along the first and second longitudinal sides at a distance from respective first and second longitudinal edges of the insert member such that when fully inserted into the tube the insert member folds along the scoring to form a spine between the scoring and first and second flaps adjacent to the scoring, wherein the first flap is disposed in the first longitudinal side and the second flap is disposed in the second longitudinal side, at least one of the first and second flaps having a width sufficient to allow the flap to wrap around an inner surface of the tube and extend behind the other flap.

Another embodiment of this invention is directed to a method of making the dual compartment dispensing tube assembly of this invention. Such method involves:

(1) providing the tube described above;

(2) providing the insert described above;

(3) placing the tube in a position suitable for filling;

(4) directing the insert member into and through the filling end of the tube until: (i) the first end of the insert member extends into the orifice formed by the neck of the tube, (ii) the first portion of the insert member abuts the inside of the shoulder of the tube, and (iii) the spine and flaps of the insert member are folded so as to provide a partition which divides the tube into two compartments;

(5) filling each of the compartments; and (6) sealing the filling end of the tube to form a straight line seal with the insert member.

DETAILED DESCRIPTION OF THE INVENTION

The present invention relates to a method of converting a standard commercially available tube into a novel co- or dual-dispensing tube by the insertion of an inexpensive insert member before the filling of the two individual components. Once installed in the tube, this insert member results in a novel co-dispensing means which will maintain the individual integrity of the two separate components until they are dispensed side-by-side in the proper proportion by the normal action of squeezing the tube.

Figure 1:
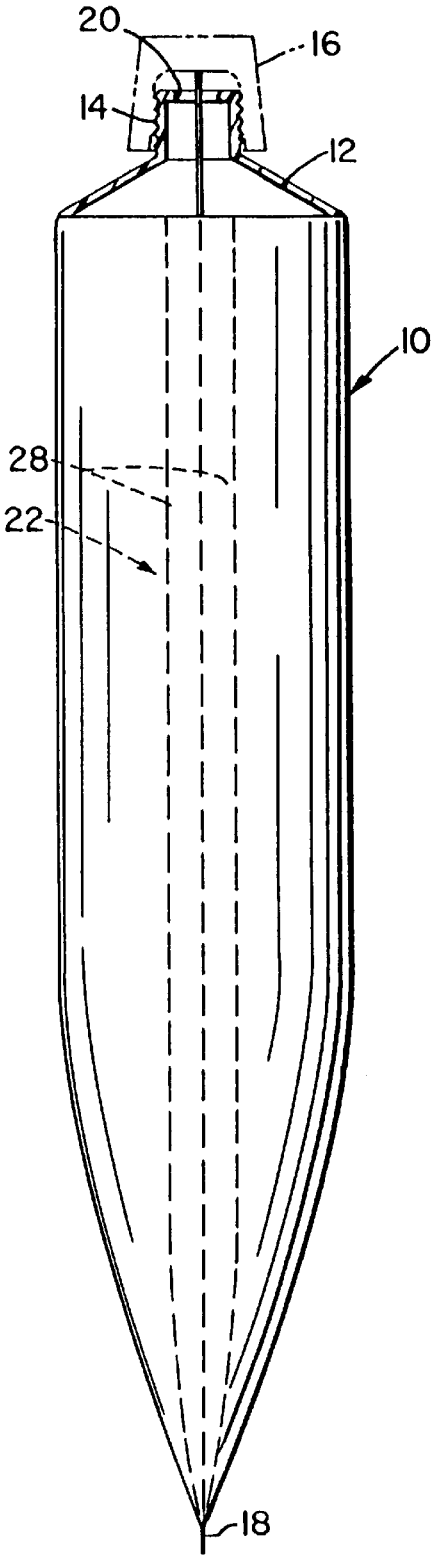
FIG. 1 is a vertical side elevation, partly in cross-section of the dual-chambered dispenser of the present invention showing the partition-forming insert member in a phantom view.
Figure 2:
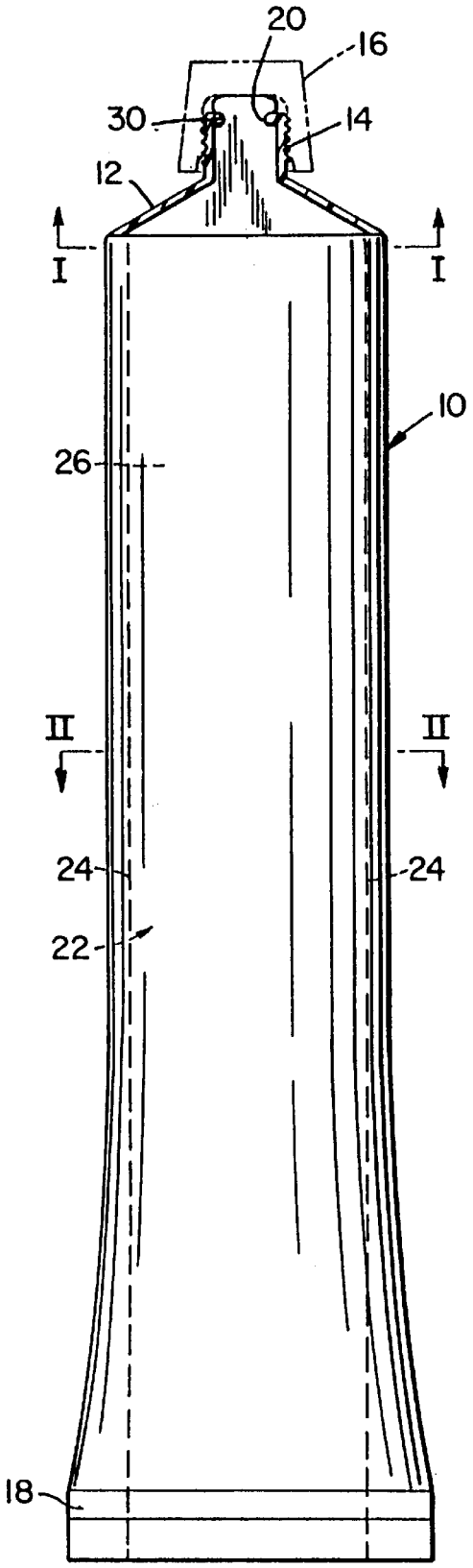
FIG. 2 is a vertical front elevation, partly in cross-section, of the dual-chambered dispenser of the present invention showing the partition-forming insert member in a phantom view and showing the insert protruding beyond the seal and before the trimming thereof.

The dual-chambered dispenser of the present invention is best viewed in FIGS. 1 and 2 of the drawings.

The dispensing tube (e.g., a toothpaste tube) illustrated in FIGS. 1 and 2 contains a tubular body generally designated 10, to one end of which is integrally united a threaded headpiece or collar 12 and tube neck 14 adapted to receive a screw cap 16 shown in phantom view. The headpiece or collar may be of any desired configuration and may be united to the tube 10 in any desirable manner. Preferably, the headpiece 12 is composed of a thermoplastic material and is formed by molding. Headpiece 12 is then fused to tube 10 in any acceptable manner known in the art.

Tubes like tube 10 customarily are formed and capped by the tube manufacturer and shipped to the packer with the bottom or filling end open. After being filled through the bottom end with a product, the tube is sealed with a transverse bottom end seal, such as seal 18.

In a preferred embodiment, the inner periphery of the neck 14 is molded or otherwise fitted to provide a collet 20. As used herein, the term "collet" is defined as a band, ferrule, flange or the like which is molded, stamped or otherwise provided around the inner diameter of the neck 14 at or near the terminus thereof. The dimensions of the collet's diameter must therefore, be smaller than the inside diameter of the neck and such collet essentially defines a dispensing orifice if it is located at or near the terminus of the neck.

In another preferred embodiment, shown in FIG. 6 and discussed later herein, one or more linear slot 32 are preformed into the inner surface of shoulder 12 and that portion of the neck 14 below the collet 20. Such slots 32 extend fully across the shoulder 12 and provide a linear space into which an insert member (discussed hereinbelow) fits.

The present invention contemplates the use of the three major types of squeezable tubes commercially available and which are suitable for dispensing products for consumer and professional use. The tubes may be classified as (1) plastic, preferably thermoplastic, tubes fabricated from a monolayer of sheet material, (2) tubes fabricated from a sheet or foil of metal, preferably aluminum, or (3) tubes fabricated from one or more sheets of the above materials which are laminated into a single sheet.

Tube 10 may be of single or of laminated construction composed of several distinct layers bonded together. Generally, tube 10 is formed from a flat web or blank which has been fabricated in a preliminary operation, an example of which is one wherein one or more thermoplastic films are extruded directly onto and bonded to opposite sides of an endless intermediate substrate. By way of illustration and not limitation, tube body 10 can be made up of an inner thermoplastic layer, an outer thermoplastic layer and an intermediate barrier layer of metallic foil, e.g., aluminum, all coextensively bonded together. Additional layers may be used, including intermediate layers of paper and/or special bonding thermoplastic adhesives formulated to provide good adherence of the thermoplastic layers to the foil layer.

The present invention is predicated on the use of a novel insert member 22 which is usually inserted into the tube 10 on the product filling line, thereby dividing the tube into two distinct chambers before filling.

Figure 3:
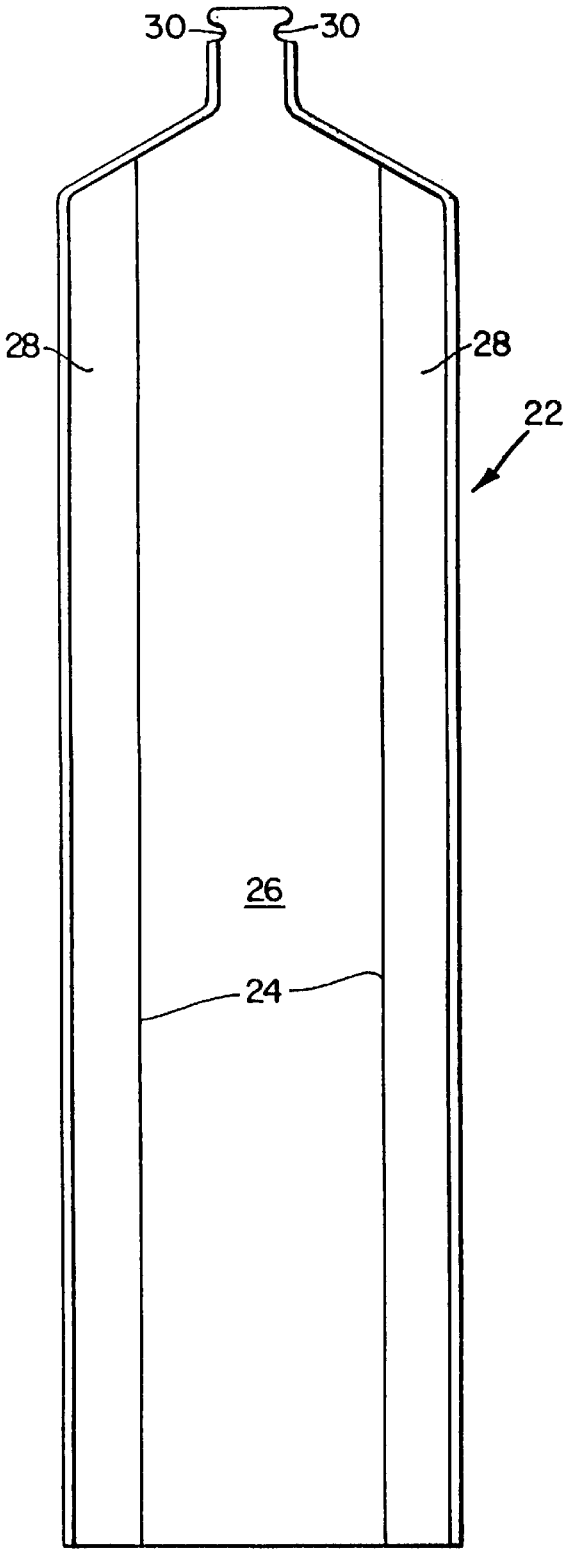
FIG. 3 is a vertical front elevation view of the partition forming insert member showing a locking notch embodiment and a multi-layered gasket embodiment.
Figure 4:
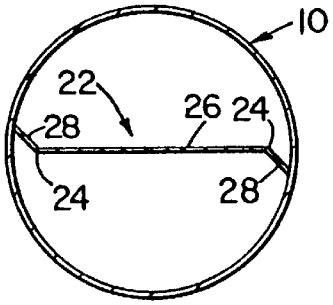
FIG. 4 is a cross-sectional view of the tube taken along line II—II of FIG. 2 and shows a first embodiment of the insert member of this invention.

Reference to FIG. 3 of the drawings illustrates the basic configuration of one embodiment of the insert member of this invention, i.e., insert member 22. FIG. 4 shows the installed insert member 22 as it would appear from the bottom of unsealed tube 10, while FIGS. 1 and 2 show the insert member 22 as it would appear in a sealed tube 10.

The insert member 22 can be made from a polymer-coated board, e.g., paper or cardboard, from plastic sheet material, e.g., thermoplastic polymeric materials such as polyethylene, from laminated boards, or from laminates of boards and polymeric sheet materials or from any other inexpensive material that can be formed and can be heat-sealed or mechanically crimped to provide sealed closure 18 to commercially available tubes.

The insert member of this invention is preferably composed of a material sufficiently resilient that such insert member tends to revert to its original planar configuration, thereby causing pressure of the flaps against the inner surface of the tube and providing a seal along the longitudinal edges of the insert member with the inner surface of the tube.

The insert member must be thick enough to withstand insertion without folding, buckling or crimping, yet be flexible enough to change form when the lower portion of the tube is flattened and sealed. The insert member can be formed to fit any commercially available tube size.

While the insert member can be formed by means of plurality of methods including the relatively costly method of molding, the insert member is preferably die cut. Thus, while the present invention provides for any method known in the art to form the insert member, the description herein shall refer to die cutting as the means of fabricating the insert member. Since die cutting merely involves the cost of a die and not the cost of molds, insert members can be made available to fit all the major tube sizes without a large investment.

Referring again to FIG. 3, an insert member 22 which, as preferred, is die cut with the width of the bottom thereof corresponding as nearly as possible to the internal width of the seal 18 with the tube 10. Scores 24 are provided, e.g., embossed, longitudinally along both sides and near the edges of insert member 22 such that the distance between the scores 24 would be less than the diameter of the tube 10. This area or space between the scores is referred to herein as the spine 26 and the two areas extending outwardly from the scores 24 and to the outer edge of the insert member 22 are referred to as the sealing flaps 28. The scores 24 are formed so the sealing flaps 28 can be folded in opposite directions. For example, the right side flap would fold upwards and if folded completely would fold onto the front of the spine and the left side flap would fold downwards and if folded completely would fold onto the back of the spine. When inserted into the tube 10 the flaps 28 and the spine 26 generally conforms to a "Z" shape. This is illustrated in the bottom view of FIG. 4.

The flaps 28 may vary in width from the top to the bottom of the insert member 22, including that area below the shoulder area, but must maintain a consistent or constant width for the spine 26. Increasing the overall width of the insert member 22 results in wider flaps which are desirable to maintain or improve flap-to-wall interaction in the sealed tube and as closely as possible to the flattened sealed end. The total width of the flaps 28 plus the spine 26 cannot exceed one-half the internal circumference of the tube 10 at the flattened sealed end 18. Other than at the flattened sealed end 18, the total of the flaps 28 and the spine 26 (with the spine having a constant width) can range up to about 50.0% greater than the dimension at the bottom.

The width of the spine 26 may range from about 50.0% to 99.0% of the diameter of the tube 10 when measured substantially above its flattened end, and is, preferably about 80.0% to 95.0% of the diameter. These dimensions provide adequate clearance for insertion of insert member 22 into tube 10 and also optimum folding angles of the flaps so as to provide the greatest pressure exerted against the wall of the tube 10.

The scoring of whatever material the insert member 22 is produced from is critical because the bend formed by the spine 26 and flap 28 must retain a memory of its flat or planar starting configuration yet allow the flap to readily and evenly fold along the line provided by the score 24. Thus, when the flap is bent it should tend to return to the flat or planar original configuration so that when the flap is restricted from returning to its original completely flat condition it applies a force against the restricting object. When placed in the tube 10 the restricting object will be the surface of tube wall. Because of the combination of the flexibility, shape and material of the flap 28 and the force applied by the bent flap, a seal is formed between the flap 28 and the wall of tube 10. The seal can be improved if the ends of the flap 28 are die cut on an angle to form an edge in the sealing direction of each flap. The angle of the edge formed should match as nearly as possible the inner surface of the periphery of the tube at the point of contact with the angled edge flap 28 of the insert member 22.

The flexibility of the flap 28 and the force provided by the score 24 is very critical to maintain a seal between the insert member and the tube wall during product addition and during and after tube sealing. When a tube is sealed, the bottom of the tube is flattened. The insert 22 is always installed into the tube so it will be parallel with the flattened portion at the tube seal 18.

The insert member 22 may be designed so that in its full flattened position, it is substantially the exact inside dimension of the tube 10 if taken as completely flattened except for the shoulder 12 and neck 14. In this way, the positioned insert member 22 transforms from a configuration of folded flaps which are force-fitted against the round tube's inner wall to a flattened form at the tube seal 18. A typical commercial tube, when sealed, goes from a round cylinder slowly flattening to being fully flattened at the seal, as seen in FIGS. 1 and 2. A flap of the insert member goes from its maximum bend against the round tube's inner surface to slowly unbending as the tube flattens and the tube walls are further away from each other when taken along the axis of the seal 18.

As mentioned above, the width of a flap 28 may vary and should preferably be sufficiently wide to optimize flap-to-tube wall interaction. The force resulting from the score 24 will maintain pressure and thereby a seal against the tube wall until the insert member is fully flat at the tube seal. The flexibility of the insert member and flap material therefore is critical, for in order to maintain a seal while the tube wall flattens out, the flap itself must twist as it opens up to its full flat width. The flap must also fold in a configuration so that when the tube is filled, the product exerts pressure against the flap with the result that increased pressure is exerted so as to optimize the seal of the flap with the wall of the tube 10.

The overall width of the insert member 22 especially at the bottom seal area is critical for it must be the same or very nearly the size of the flattened inside of the tube at the sealing area. It is characterized, therefore, as being about one-half the inside circumference of tube 10. The insert member 22 must seal or crimp between the two inner sides of the flattened tube and must be made from or coated with material to produce an effective sandwich seal. The seal is, therefore, made up of three layers which are tube, insert and tube. Laminated and plastic tubes are heat-sealed so the insert member 22 must be made of material or coated with material that is compatible and will seal with the tube 10.

The flaps 28 seal the insert member 22 against the tube walls. The top portion of the insert member 22 is die cut to exactly duplicate the shape of the inside of the tube collar 12 and neck 14 (see FIG. 2). The insert member 22 also protrudes beyond the neck 14 and out through the tube's dispensing orifice (see FIGS. 1 and 2). This extension beyond the dispensing orifice of the tube can be shaped to form a linear seal inside the tube cap 16. This maintains separation of the two products even into the cap and provides a seal which prevents cross contamination of the products within the filled tube.

The top of the insert member 22 that extends beyond the dispensing orifice of the tube 10 can have a notch 30 cut on both sides which catch on or otherwise engage the flange of the collet 20 positioned in the tube orifice to act as a positive lock to hold the insert member 22 in place during the product filling and sealing of the tube 10 (see FIG. 2). This lock is designed and positioned so it forces the insert member to remain sealed against the inside of the tube collar 14.

Figure 5:
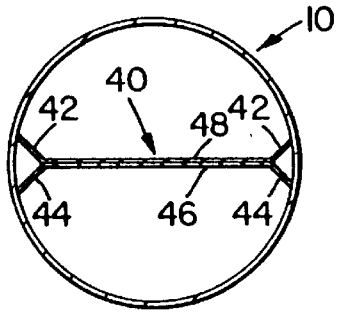
FIG. 5 is a cross-sectional view of a second embodiment of the insert member of this invention, wherein the insert member is a layered insert member composed of two inserts and four sealing flaps.

FIG. 5 illustrates an embodiment of an insert member 40 similar to the basic insert design described above, except that it provides better sealing of the insert member 40 within the tube 10. In this embodiment, the flaps do not form a "Z"

fold (one flap up and one flap down) as in the basic insert unit shown in FIG. 4, for example. Instead, insert member 40 has four flaps 42—42 and 44—44 which fold up and down, respectively, when two insert components 46 and 48 are attached back to back. Each of the insert components 46 and 48 are made of thinner material than the basic designed insert 22 so that each of the four flaps would be more flexible for better sealing, while the spine, which is composed of two laminated insert components (46 and 48), has the structural integrity to be forced into the tube without bending or crimping. The two insert components 46 and 48 can be heat-sealed or glued together at the spine to form the laminated insert member 40.

The portion of the flaps corresponding to the tube collar or shoulder are tapered so as to fit the contour of the inside of the tube collar 12, and inasmuch as the flaps are thinner, they do not have to be folded back out of the way before insertion into the tube. The tapered portion of the insert member 40 fits into the open tube which begins splitting the adjacent flaps 42–44 apart as the insert member is pushed further into the tube.

In the insert member embodiment shown in FIG. 5, as with the single layer insert member illustrated in FIG. 4, the flaps do not have to be permanently prefolded with the possible loss of some of their memory and the force required to seal against the tube wall. Advantageously, this allows for easier stacking (not unlike a deck of cards) and facilitation of the handling of the insert member in automated inserting equipment.

In accordance with the present invention, a plurality of embodiments are also contemplated which provide chemical and/or mechanical seal means in addition to the basic pressure seal, and thereby improves the sealing of the embodiments of FIGS. 4 and 5. For example, heat or sonic means may be used to seal the insert member or any part thereof to the tube from the outside of the tube, without affecting the integrity or appearance of the tube or the contents therein. In addition, non-contaminating materials can be put onto the edges of the finished insert member, which will improve the seal between the insert member and the inner surface of the tube when the insert member is inserted into the tube. This chemical and/or mechanical seal enhancement can be accomplished in several different ways.

For example, one way in which seal enhancement can be achieved is by using an adhesive and/or caulking type material which is applied to the edges of the insert member.

Another way to achieve seal enhancement is to use a polymeric type material which is applied to the cut edges of the insert member and which swells and becomes tacky when contacted by water or moisture contained in the product, thereby forming the desired seal. The polymer is chosen based on its speed of swelling, tackiness and insolubility, so that it sets rapidly, remains in place and does not contaminate the product.

Yet another way to achieve seal enhancement is to use a suitable polymeric material to help seal the edges as described above except the polymer is applied to the board before it is coated or laminated with a polymeric material as hereinbefore described. Thus, the sealing polymer is only exposed at the edges of the insert member once the board is coated or laminated and then die cut. Only where the cut edge, i.e., the sealing edge, of the board is exposed to product moisture does the polymer swell. Consequently, this system only forms a seal at the edge of the insert if moisture from the product contacts it. If the product does not migrate and reach an exposed edge due to effective pressure sealing, then the area is not in need of additional sealing. As the filled tube is used by consumers, if a slight shift of the insert or a change in the tube's shape weakens a seal, the insert member provides in situ polymer where needed to continuously reform seals.

Another way to achieve seal enhancement can be utilized with either of the configurations of FIGS. 4 and 5. This embodiment die cuts the insert member before the polycoating or lamination step and then laminates both sides of the insert member with a precut polymeric film or sheet or other tube sealing compatible film. The film to be laminated over the already die cut board would be patterned to the exact as possible to the outline of the flat insert except that it overlaps by a short distance, such as about one-eighth inch, around the entire periphery of the flat insert member. The insert member would be laminated front and back with this cut and thus patterned sheet material. Where the front and back polymeric sheets overlap the board they are sealed to each other. Where the two sheets seal to each other they form a flexible gasket entirely around the edge or periphery of the insert. When inserted into the tube, such gasket provides improved sealing with essentially every surface the insert contacts once installed into the tube.

Figure 6:
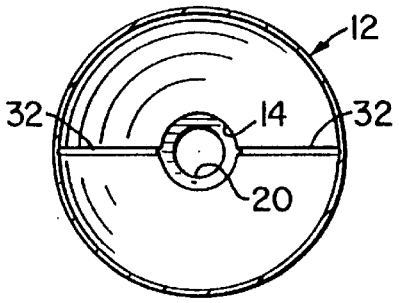
FIG. 6 is a cross-sectional view of the shoulder and neck taken along line 1—1 of FIG. 2.

FIG. 6 also illustrates an embodiment which improves sealing and also facilitates positioning of the insert member 22 within the tube 10. Such embodiment involves molding or otherwise preforming one or more linear slots 32 into the inner surface of the shoulder 12 and that portion of the neck 14 below the collet 20. Such slot(s) 32 which extends fully across the shoulder 12 provides a linear space into which the insert member 22 fits and thereby provides a positioning guide and insert support. The slot(s) at the widest part of shoulder 12, i.e, the point of insertion, is slightly larger than the inner diameter of the shoulder as well as that of the neck 14 at the corresponding point. The dimensions of the insert member 22 would accordingly be increased at the shoulder portion and the neck to correspond to the depth of the slot(s) 32 in the shoulder and neck. Thus, if slot(s) 32 is present, the end of the insert member corresponding to the dispensing end of the tube will have an inner diameter which is larger than the inner diameter of the neck such that the insert member substantially fills voids provided by the slot(s).

For illustrative purposes only, the dimensions of the shoulder generally are such that the thickness of the molded shoulder is about 0.035 to 0.040 inch (35–40 mil) with the slot(s) being from about 0.010 to 0.015 inch (10–15 mil) deep. The width of the slot(s) should be from about 0.001 to 0.005 (1 to 5 mil) greater than the thickness of the insert member 22. The insert member 22 will, accordingly, be increased correspondingly in planar dimensions so as to fill the space provided by the slots 32. Generally about 0.001 to 0.005 inch (1–5 mil) clearance is provided for ease of insertion and in order to prevent buckling.

Figure 7:
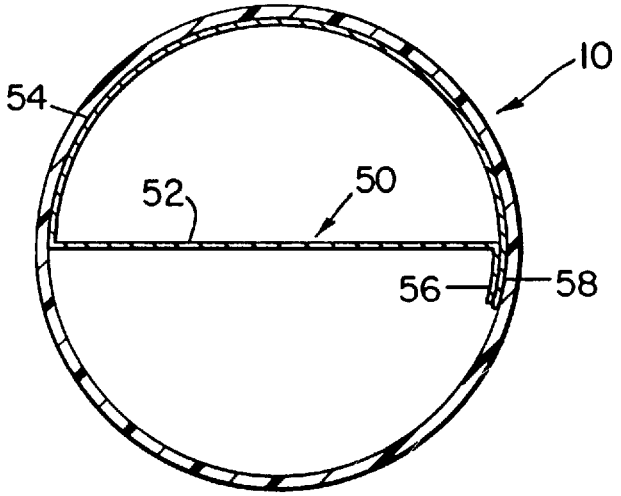
FIG. 7 is a cross-sectional view showing a third embodiment of the insert member of this invention, wherein one of the sealing flaps wraps around the inner wall of the tube and extends behind the other flap on the other side of the tube.

FIG. 7 shows another embodiment of the insert member of this invention. In FIG. 7, insert member 50 is disposed within tube 10 and is composed of a spine 52 and two flaps 54 and 56. Flap 54 is extended such that it wraps around the inner wall of tube 10 and extends behind flap 56 on the other side of tube 10. Portions of flaps 54 and 56 overlap to form a two-layer flap 58, wherein flaps 54 and 56 can be heat-sealed or glued to each other to form a tube within tube 10.

Figure 8:
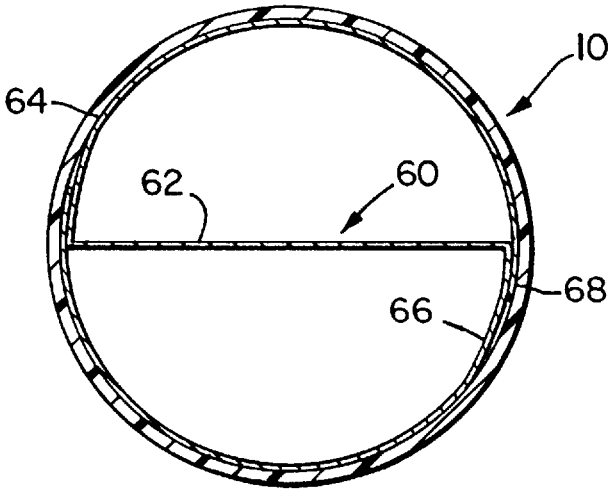
FIG. 8 is a cross-sectional view showing a fourth embodiment of the insert member of this invention, wherein each of the sealing flaps wraps around the inner wall of the tube and extends behind the other flap on the other side of the tube.

FIG. 8 shows another embodiment of the insert member of this invention, which is a variation of the insert member shown in FIG. 7. In FIG. 8, insert member 60 is disposed within tube 10 and is composed of a spine 62 and two flaps 64 and 66. Flaps 64 and 66 are both extended such that each flap wraps around the inner wall of tube 10 and extends behind the other flap on the other side of tube 10. Portions of flaps 64 and 66 overlap to form a two-layer flap 68, wherein flaps 64 and 66 can be heat-sealed or glued to each other to form a tube within tube 10.

Figure 9:
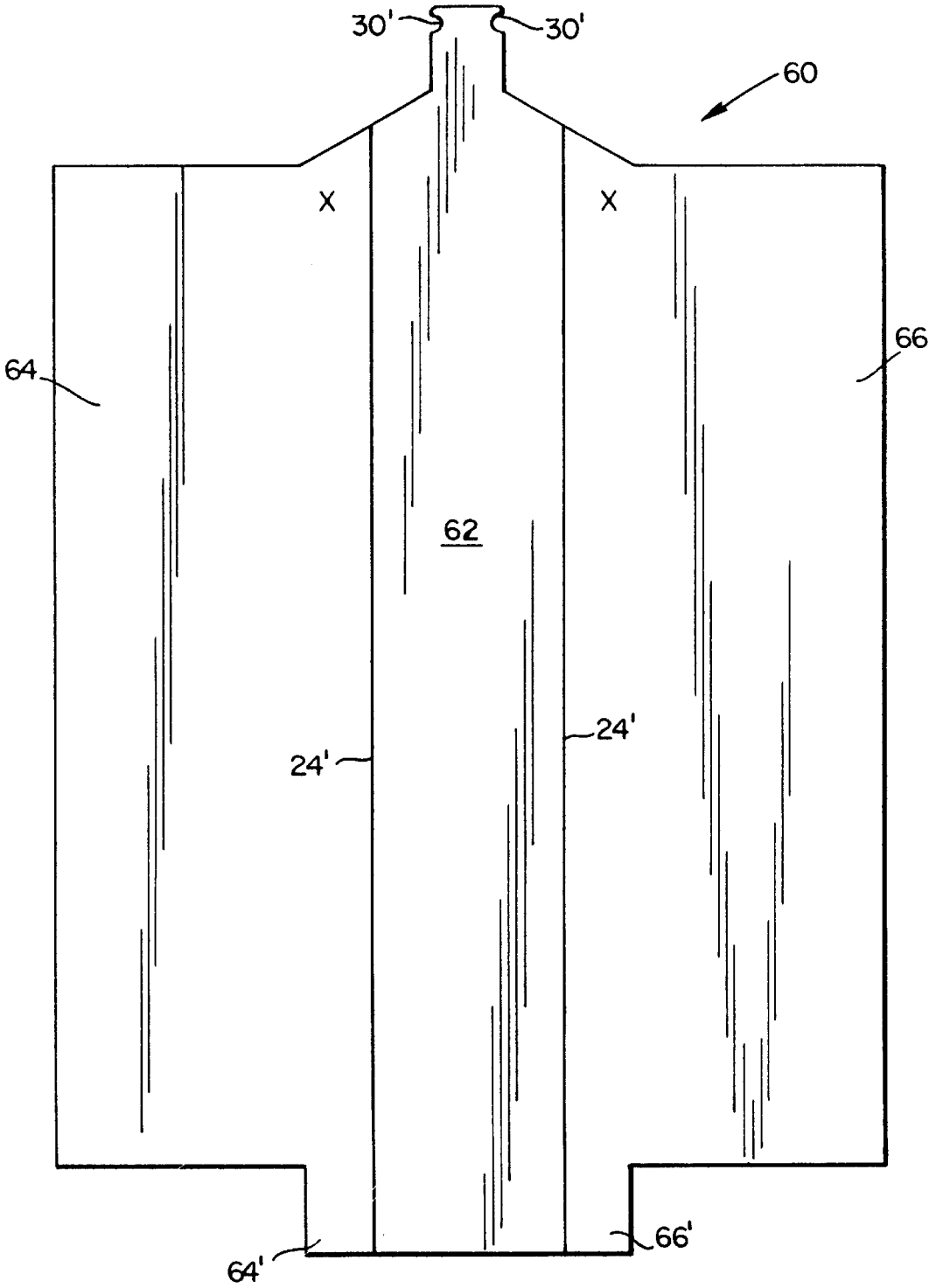
FIG. 9 is a vertical front elevation view of the insert member of FIG. 8, wherein the sealing flaps are shown in outstretched positions.

FIG. 9 shows a view of the the insert member 60 of FIG. 8 wherein sealing flaps 64 and 66 are shown in outstetched positions. Scores 24' are provided, e.g., embossed, longitudinally along both sides and near the edges of insert member 60 such that the distance between the scores 24' (i.e., the width of spine 62) would be equal to or slightly less than the diameter of the tube. The total width of the spine 62 and bottom portions 64' and 66' of respective flaps 64 and 66 cannot exceed about one-half the internal circumference of the tube at the flattened sealed end.

Like insert member 22 shown in FIG. 3, insert member 60 shown in FIG. 9 may have at the top thereof a notch 30' cut on both sides which catch on or otherwise engage the flange of a collet (not shown) positioned in the tube orifice (not shown) to act as a positive lock to hold the insert member 60 in place during the product filling and sealing of the tube.

As stated above, flaps 64 and 66 of insert member 60 can be heat-sealed or glued to each other to form a tube within tube 10. Insert member 60 may also be heat-sealed or sonnicated to the side of tube 10, preferably, at points x shown in FIG. 9. The reason for heat-sealing or gluing the overlapping portions of the flaps and/or heat-sealing or sonnicating the insert member to the side of the tube is to minimize any possible carry-over of product from one side (compartment) to the other side (compartment). This ensures fluoride stability.

There are alternate methods of manufacturing the present embodiment, such as die cutting the inserts and laminating them between top and bottom continuous sheets of polymeric material. This is followed by a second die cut of the now laminated insert, but slightly larger than the outline of the insert member itself, so the polymeric material extends beyond the outline of the insert member to form a gasket.

The present invention is further directed to a dual compartment dispensing tube assembly composed of the aforementioned tube and the aforementioned substantially planar partition-forming insert member positioned in the tube, wherein the insert member provides the two adjacent compartments defined by a common wall segment and a pair of outer arcuate walls.

In the dual compartment assembly of this invention, the insert member is preferably composed of a material sufficiently resilient such that the insert member tends to revert to an original planar configuration thereof, thereby causing pressure of the flaps against the inner arcuate walls of the tube, thereby providing a pressure seal along the longitudinal edges of the insert member with a surface of the arcuate walls.

In accordance with the present invention, a method for assembling the dual-compartment dispensing tube assembly involves placing the tube on a filling line in an indexed position suitable for filling and sealing and directing the insert into and through the filling end of the tube until the end portion of the insert extends through and, beyond the orifice formed by the neck and the shoulder portion of the insert abuts the inside of the shoulder of the tube. The insert is directed in such a manner so that the spine and flaps are folded into either a generally "Z" shape of FIG. 4, the four flap, laminated spine, of FIG. 5, or as shown in FIGS. 7 and 8, and provide a partition which divides the tube into two compartments. Each of the compartments are filled and the filling end of the tube is sealed by heat, crimping or the like to form a straight line seal with planar insert. Preferably, the tube neck is cylindrical and has a collet or slots on the inner periphery thereof which engage diametrically opposed notches provided in the neck portion of the insert when it is directed into the tube. If desired the terminal dispensing end of the planar insert is of a configuration which compliments that of the inner surface of the closing cap such that when directed into the tube the insert extends through and beyond the orifice formed by the neck for a distance sufficient to form a linear seal within the cap.

While particular embodiments of the present invention have been illustrated and described, it will be obvious to those skilled in the art that various changes and modifications can be made without departing from the spirit and scope of the invention and it is intended to cover in the appended claims all such changes and modifications that are within the scope of this invention.

What is claimed is:

1. A substantially planar partition-forming insert member suitable for insertion into a dispensing tube to form a partition and two separate and discrete compartments within the tube, said tube having a dispensing end and an open filling end, said dispensing end being affixed to a shoulder and a neck terminating as a dispensing orifice and adapted to receive a closing cap, said insert member being inserted into said open filling end prior to a filling of said open end; said insert member comprising:

(A) a first end corresponding to the dispensing end of the tube;

(B) a first portion adjacent to said first end;

(C) a mid-portion adjacent to said first portion;

(D) a terminal end corresponding to the filling end of the tube; and (E) first and second longitudinal sides;

wherein said insert member has a configuration such that when said insert member is inserted into the tube:

(i) the first end of the insert member corresponding to the dispensing end of the tube is larger than or substantially equal to the inner diameter of the neck and extends into said neck, (ii) the first portion of the insert member conforms to the shape of the tube shoulder, (iii) the mid-portion of the insert member extends within the tube and has a width corresponding to at least one-half the inner circumference of the tube, and (iv) the terminal end of the insert member corresponding to the filling end of the tube has a width substantially equal to one-half the inner circumference of said tube;

further wherein said insert member comprises foldable portions along said first and second longitudinal sides at a distance from respective first and second longitudinal edges of said insert member such that when fully inserted into the tube the insert member folds along the foldable portions to form a spine between the foldable portions and first and second flaps adjacent to said foldable portions, wherein said first flap is disposed in said first longitudinal side and said second flap is disposed in said second longitudinal side, at least one of said first and second flaps having a width sufficient to allow said flap to wrap around an inner surface of said tube and extend behind the other flap.

2. The insert member of claim 1, wherein said first and second flaps both have a width sufficient to allow said flaps to wrap around said inner surface of said tube and extend behind the other flap.

3. The insert member of claim 1, wherein at least one of said first and second flaps is heat-sealed or glued to the other flap.

4. The insert member of claim 1, wherein said insert member is comprised of a material sufficiently resilient that such member tends to revert to its original planar configuration, thereby causing pressure of the flaps against the inner surface of the tube and providing a seal along the longitudinal edges of said member with said inner surface of the tube.

5. The insert member of claim 1, wherein the first end of said member is provided with diametrically opposed notches which engage a collet positioned on an inner periphery of the neck of the tube when said notches are inserted therethrough.

6. The insert member of claim 1, wherein said member is die cut.

7. The insert member of claim 1, wherein said member is comprised of a material which is bondable with a surface of the tube.

8. The insert member of claim 1, wherein said member is formed from plastic sheet material, board material coated with a polymeric material, or a combination thereof.

9. The insert member of claim 8, wherein said member comprises an inner layer of a board material and two outer layers of polymeric sheet material, the total planar dimensions of said outer layers of polymeric sheets being greater than those of the inner layer of board material, thereby resulting in a polymeric sheet-to-polymeric sheet overlapping in a plane with and around an edge of said member, further wherein said overlapping sheets are laminated together to form a flexible sealing gasket in a plane with and around the edge of said member.

10. The insert member of claim 1, which is comprised of two similar insert members positioned and adhered together so as to form one integral planar spine having four longitudinal scores and four oppositely projecting flaps.

11. The insert member of claim 1, wherein edges of said first and second flaps are cut at an angle to form a biased surface in the sealing direction of each flap.

12. The insert member of claim 1, wherein edges of said member which contact the inner surface of the tube are provided with non-contaminating sealing material.

13. The insert member of claim 1, wherein the first end of said member is of a configuration which compliments that of an inner surface of the closing cap such that when said member extends through and beyond an orifice formed by the neck of the tube for a sufficient distance said member forms a linear seal within the cap.

14. The insert member of claim 1, wherein said foldable portions comprise scoring along said first and second longitudinal sides at a distance from the respective first and second longitudinal edges of said insert member such that when fully inserted into the tube the insert member folds along the scoring to form a spine between the scoring and first and second flaps adjacent to said scoring.

15. A dual compartment dispensing tube assembly, comprising:

(a) a tube having two adjacent compartments, a dispensing end and a filling end, said dispensing end having affixed thereto a shoulder and a neck terminating as a dispensing orifice and adapted to receive a closing cap, said filling end being sealed after contents are placed in said compartments; and (b) a substantially planar partition-forming insert member positioned in said tube, said insert member providing said two adjacent compartments defined by a common wall segment and a pair of outer arcuate walls, said insert member comprising:

(A) a first end corresponding to the dispensing end of the tube;

(B) a first portion adjacent to said first end;

(C) a mid-portion adjacent to said first portion;

(D) a terminal end corresponding to the filling end of the tube; and (E) first and second longitudinal sides;

wherein in flattened form said insert member has a configuration generally conforming to that of the tube, further wherein said insert member has a configuration such that when said insert member is inserted into the tube:

(i) the first end of the insert member corresponding to the dispensing end of the tube is larger than or substantially equal to the inner diameter of the neck and extends into said neck, (ii) the first portion of the insert member conforms to the shape of the tube shoulder, (iii) the mid-portion of the insert member extends within the tube and has a width corresponding to at least one-half the inner circumference of the tube, and (iv) the terminal end of the insert member corresponding to the filling end of the tube has a width substantially equal to one-half the inner circumference of said tube;

further wherein said insert member comprising foldable portions along said first and second longitudinal sides at a distance from respective first and second longitudinal edges of said insert member such that when fully inserted into the tube the insert member folds along the foldable portions to form a spine between the foldable portions and first and second flaps adjacent to said foldable portions, wherein said first flap is disposed in said first longitudinal side and said second flap is disposed in said second longitudinal side, at least one of said first and second flaps having a width sufficient to allow said flap to wrap around an inner surface of said tube and extend behind the other flap.

16. The assembly of claim 15, wherein said foldable portions comprise scoring along said first and second longitudinal sides at a distance from the respective first and second longitudinal edges of said insert member such that when fully inserted into the tube the insert member folds along the scoring to form a spine between the scoring and first and second flaps adjacent to said scoring.

17. The assembly of claim 15, wherein said first and second flaps both have a width sufficient to allow said flaps to wrap around said inner surface of said tube and extend behind the other flap.

18. The assembly of claim 15, wherein at least one of said first and second flaps is heat-sealed or glued to the other flap.

19. The assembly of claim 15, wherein said insert member is heat-sealed or sonnicated to a side of said tube.

20. The assembly of claim 15, wherein said insert member is comprised of a material sufficiently resilient such that the insert member tends to revert to an original planar configuration thereof, thereby causing pressure of the flaps against the inner arcuate walls, thereby providing a pressure seal along the longitudinal edges of said member with a surface of said arcuate walls.

21. The assembly of claim 15, wherein the insert member is comprised of a material which is bondable with a surface of said tube.

22. The assembly of claim 15, wherein the first end of the insert member is provided with diametrically opposed notches which engage a collet positioned on an inner periphery of the neck when said insert member is inserted therethrough.

23. The assembly of claim 15, wherein said insert member is die cut.

24. The assembly of claim 15, wherein said insert member is formed from plastic sheet material, board material coated with a polymeric material, or a combination thereof.

25. The assembly of claim 24, wherein said insert member comprises an inner layer of board material and two outer layers of polymeric sheet material, the total planar dimensions of said outer layers of polymeric sheets being greater than those of the inner layer of board material, thereby resulting in a sheet-to-sheet overlapping in a plane with and around an edge of said insert member, said overlapping sheets being laminated together to form a flexible sealing gasket in a plane with and around the edge of said insert member.

26. The assembly of claim 16, wherein the insert member is comprised of two similar planar members positioned and adhered together so as to form one integral insert having four longitudinal scores which define a spine and four oppositely projecting flaps.

27. The assembly of claim 15, wherein edges of the flaps are cut at an angle to form a biased surface in the sealing direction of each flap.

28. The assembly of claim 15, wherein edges of the insert member which contact the inner surface of the tube are provided with non-contaminating sealing material.

29. The assembly of claim 15, wherein the first end of said insert member is of a configuration which compliments that of an inner surface of the closing cap such that said insert member extends through and beyond the orifice formed by the neck for a distance sufficient to form a linear seal within the cap.

30. The assembly of claim 15, wherein the shoulder and neck of said tube comprise one or more slots into which the insert member fits, wherein the first end of said insert member corresponding to the dispensing end of the tube is larger than the inner diameter of the neck such that said insert member substantially fills voids provided by said slots.

31. The assembly of claim 15, wherein the tube is an extended tubular cylinder comprised of thermoplastic material, aluminum, or a laminated combination of at least two materials from any one or more of the above materials.

32. The assembly of claim 15, wherein, after being filled, the filling end of said tube is sealed to form a straight line seal at said filling end with said insert member.

33. The assembly of claim 15, wherein the tube has a cross-section which is a circle or an ellipsoid.

34. A method for assembling a dual compartment dispensing tube assembly comprising:

(a) a tube having two adjacent compartments, a dispensing end and a filling end, said dispensing end having affixed thereto a shoulder and a neck terminating as a dispensing orifice and adapted to receive a closing cap, said filling end being sealed after contents are placed in said compartments; and (b) a substantially planar partition-forming insert member positioned in said tube, said insert member providing said two adjacent compartments defined by a common wall segment and a pair of outer arcuate walls, said insert member comprising:

(A) a first end corresponding to the dispensing end of the tube;

(B) a first portion adjacent to said first end;

(C) a mid-portion adjacent to said first portion;

(D) a terminal end corresponding to the filling end of the tube; and (E) first and second longitudinal sides;

wherein in flattened form said insert member has a configuration generally conforming to that of the tube, further wherein said insert member has a configuration such that when said insert member is inserted into the tube:

(i) the first end of the insert member corresponding to the dispensing end of the tube is larger than or substantially equal to the inner diameter of the neck and extends into said neck, (ii) the first portion of the insert member conforms to the shape of the tube shoulder, (iii) the mid-portion of the insert member extends within the tube and has a width corresponding to at least one-half the inner circumference of the tube, and (iv) the terminal end of the insert member corresponding to the filling end of the tube has a width substantially equal to one-half the inner circumference of said tube;

further wherein said insert member comprises foldable portions along said first and second longitudinal sides at a distance from respective first and second longitudinal edges of said insert member such that when fully inserted into the tube the insert member folds along the foldable portions to form a spine between the foldable portions and first and second flaps adjacent to said foldable portions, wherein said first flap is disposed in said first longitudinal side and said second flap is disposed in said second longitudinal side, at least one of said first and second flaps having a width sufficient to allow said flap to wrap around an inner surface of said tube and extend behind the other flap;

wherein said method comprises the steps of:

(1) placing the tube in a position suitable for filling;

(2) directing the insert member into and through the filling end of the tube until: (i) the first end of the insert member extends into the orifice formed by the neck of the tube, (ii) the first portion of the insert member abuts the inside of the shoulder of the tube, and (iii) the spine and flaps of said insert member are folded so as to provide a partition which divides the tube into two compartments;

(3) filling each of the compartments; and (4) sealing the filling end of the tube to form a straight line seal with the insert member.

35. The method of claim 34, wherein said foldable portions comprise scoring along said first and second longitudinal sides at a distance from the respective first and second longitudinal edges of said insert member such that when fully inserted into the tube the insert member folds along the scoring to form a spine between the scoring and first and second flaps adjacent to said scoring.

36. The method of claim 34, wherein said first and second flaps both have a width sufficient to allow said flaps to wrap around said inner surface of said tube and extend behind the other flap.

37. The method of claim 34, wherein at least one of said first and second flaps is heat-sealed or glued to the other flap.

38. The method of claim 34, wherein the insert member is heat-sealed or sonnicated to a side of the tube.

39. The method of claim 34, wherein the neck of the tube is cylindrical and has a collet positioned on an inner periphery thereof which engages diametrically opposed notches provided in the first end of the insert member.

40. The method of claim 34, wherein the first end of the insert member is guided into and positioned in slots provided in an inner surface of the neck and shoulder of the tube.

41. The method of claim 34, wherein the insert member is comprised of a material which is bondable with a surface of said tube.

42. The method of claim 34, wherein said insert member is die cut.

43. The method of claim 34, wherein said insert member is formed from polymeric sheet material, board material coated with a polymeric material, or a combination thereof.

44. The method of claim 43, wherein said insert member comprises an inner layer of board material and two outer layers of polymeric sheet material, the total planar dimensions of said outer layers of polymeric sheets being greater than those of the inner layer of board material, thereby resulting in a sheet-to-sheet overlapping in a plane with and around an edge of said insert member, said overlapping polymeric sheets being laminated together to form a flexible sealing gasket in a plane with and around the edge of said insert member.

45. The method of claim 35, wherein the insert member is comprised of two similar planar members positioned and adhered together so as to form one integral insert having four longitudinal scores which define a spine and four oppositely-disposed projecting flaps.

46. The method of claim 34, wherein edges of the flaps are die cut at an angle to form a biased surface in the sealing direction of each flap.

47. The method of claim 34, wherein edges of the insert member which contact the inner surface of the tube are provided with a non-contaminating sealing material.

48. The method of claim 34, wherein the first end of said insert member is of a configuration which compliments that of an inner surface of the closing cap such that said insert member extends through and beyond the orifice formed by the neck of said tube for a distance sufficient to form a linear seal within the cap.

49. The method of claim 34, wherein the tube is an extruded tubular cylinder comprised of thermoplastic material, aluminum, or a laminated combination of at least two materials from any one or more of the above materials.

50. The method of claim 34, wherein the tube has a cross-section which is a circle or an ellipsoid.

* * * * *